US006947006B2

(12) United States Patent
Diximus et al.

(10) Patent No.: US 6,947,006 B2
(45) Date of Patent: Sep. 20, 2005

(54) COLINEAR ANTENNA OF THE ALTERNATING COAXIAL TYPE

(75) Inventors: Frédéric Diximus, Dole (FR); David Oliveira, Gevry (FR); Daniel Leclerc, Crissey (FR)

(73) Assignee: Amphenol Socapex (FR)

( * ) Notice: Subject to any disclaimer, the term of this patent is extended or adjusted under 35 U.S.C. 154(b) by 32 days.

(21) Appl. No.: 10/734,113

(22) Filed: Dec. 15, 2003

(65) Prior Publication Data

US 2004/0125038 A1 Jul. 1, 2004

(30) Foreign Application Priority Data

Dec. 20, 2002 (FR) ..... 02 16293

(51) Int. Cl.[7] ..... H01Q 1/16
(52) U.S. Cl. ..... 343/790; 343/791; 343/792
(58) Field of Search ..... 343/790, 791, 343/792, 905, 793, 810; H01Q 1/16

(56) References Cited

U.S. PATENT DOCUMENTS 2,158,376 A 5/1939 Moser et al. ..... 250/33
5,600,338 A 2/1997 Ecklund et al. ..... 343/790
5,719,587 A * 2/1998 Rodal ..... 343/791
6,057,804 A 5/2000 Kaegebein ..... 343/792
6,771,227 B2 * 8/2004 Tsai et al. ..... 343/801
6,836,256 B2 * 12/2004 Hung ..... 343/790
2003/0080916 A1 * 5/2003 Zeilinger et al. ..... 343/792

FOREIGN PATENT DOCUMENTS

EP 0 411 363 7/1990

* cited by examiner

*Primary Examiner*—Hoanganh Le
(74) *Attorney, Agent, or Firm*—Blank Rome LLP

(57) ABSTRACT

The invention relates to an antenna of colinear type. It comprises a radiating portion comprising:

three substantially rectilinear conductive wire elements that are mutually parallel, comprising a central conductor and two lateral conductors; and 2N radiating zones constituted by alternating first radiating zones and second radiating zones:

each first radiating zone further comprising a cylindrical conductive element whose axis coincides with said central wire element and which is electrically connected to both of said lateral wire elements; and each second radiating zone further comprises two cylindrical conductive elements whose axes coincide substantially respectively with the lateral wire elements, said cylindrical elements being electrically connected to said central wire element.

5 Claims, 2 Drawing Sheets

COLINEAR ANTENNA OF THE ALTERNATING COAXIAL TYPE

The present invention relates to a colinear antenna of the alternating coaxial type.

BACKGROUND OF THE INVENTION

Such antennas have already been described, in particular in U.S. Pat. No. 2,158,376, a figure of that patent being reproduced as accompanying FIG. 1.

The antenna is constituted by a sequence of dipoles D1, D2, D3, etc. connected to one another by a system of phase shifters DF1, DF2, etc. More precisely, each dipole D1 is constituted by a cylindrical conductive element 10 and the antenna also comprises two parallel rectilinear conductive elements 12 and 14. The cylindrical conductive elements 10 constituting the dipoles D1, D2, D3 are bonded in alternation to one of the conductors 12 and 14 while surrounding the other conductor. For example, the dipole D1 is constituted by a cylindrical element 10 that is coaxial about conductive element 14 and that is bonded to conductive element 12. The phase shifter elements DF are thus constituted by the same conductive element 12, 14 passing from a position where it is bonded to the cylindrical conductive element to a position where it is disposed on the axis of the following cylindrical conductive element. This change in disposition corresponds substantially to a phase shift of $\lambda/2$. Thus, currents flowing in the conductive portions 12 and 14 corresponding to the different dipoles are summed overall. However, the alternating positions of the conductive cylinders about the two conductive rectilinear elements causes the radiation pattern of the antenna assembly to be asymmetrical, and as a result the antenna is not omnidirectional.

Another drawback of the antenna described in the above-cited US patent lies in the fact that each dipole is constituted by a cylindrical conductive element and the linear conductor placed on the axis of said cylinder. This leads to a configuration in which the physical length of the cylindrical element does not correspond to its radiating length. The antenna is thus not properly tuned to its working frequency.

OBJECTS AND SUMMARY OF THE INVENTION

An object of the present invention is to provide a colinear antenna of alternating coaxial type that enables current distribution to be obtained in the antenna in such a manner that its radiation pattern is effectively omnidirectional.

According to the invention, this object is achieved by an antenna of colinear type which has a radiating portion comprising:

- three substantially rectilinear conductive wire elements that are mutually parallel, comprising a central conductor and two lateral conductors; and
- 2N radiating zones constituted by alternating first radiating zones and second radiating zones:
  - each first radiating zone further comprising a cylindrical conductive element whose axis coincides with said central wire element and which is electrically connected to both of said lateral wire elements; and
  - each second radiating zone further comprises two cylindrical conductive elements whose axes coincide substantially respectively with the lateral wire elements, said cylindrical elements being electrically connected to said central wire element; a gap being left between two consecutive radiating zones.

It will be understood that because the successive dipoles are constituted by radiating elements formed successively by a single conductive cylindrical element and by two conductive cylindrical elements, and in addition the antenna has three linear conductive elements, the structure of the antenna is symmetrical and the radiated electric field is therefore also symmetrical.

Each cylindrical element is of length L and contains internally a disk of a dielectric material having a dielectric coefficient $\in$, the disk extending orthogonally to the wire element and being of length l' in the direction of the wire element such that:

$$L+\in l'=\lambda/2$$

Because of the presence of the disk of dielectric material inside each cylindrical conductive element, it is possible to compensate for the difference which exists between the physical length of the cylindrical conductive element and its electrical length as an antenna, but without that making the antenna more complex to build. It will also be understood that these disks of dielectric material serve to hold the cylindrical elements mechanically relative to the rectilinear conductive wire elements.

BRIEF DESCRIPTION OF THE DRAWINGS

Other characteristics and advantages of the invention appear better on reading the following description of embodiments of the invention given as non-limiting examples.

The description refers to the accompanying drawings, in which.

MORE DETAILED DESCRIPTION

Figure 1:
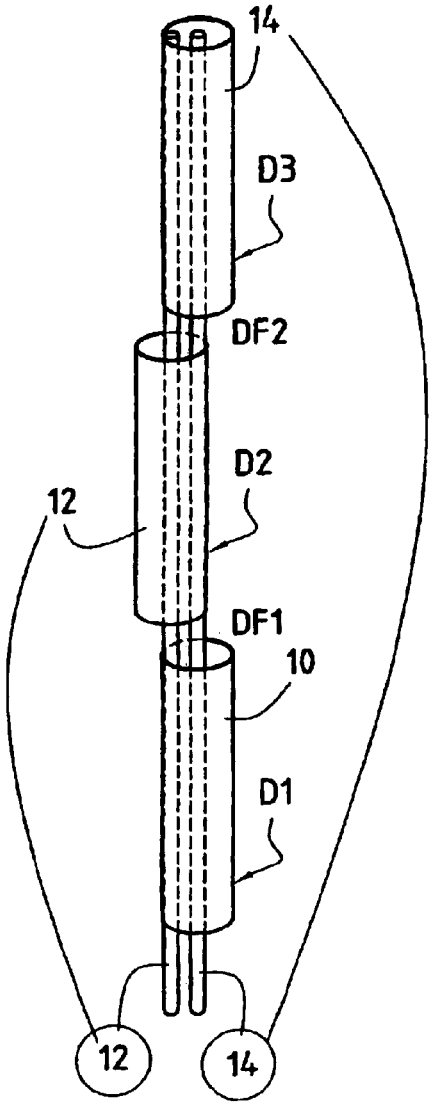
FIG. 1, described above, shows an alternating coaxial colinear antenna of known type.
Figure 2:
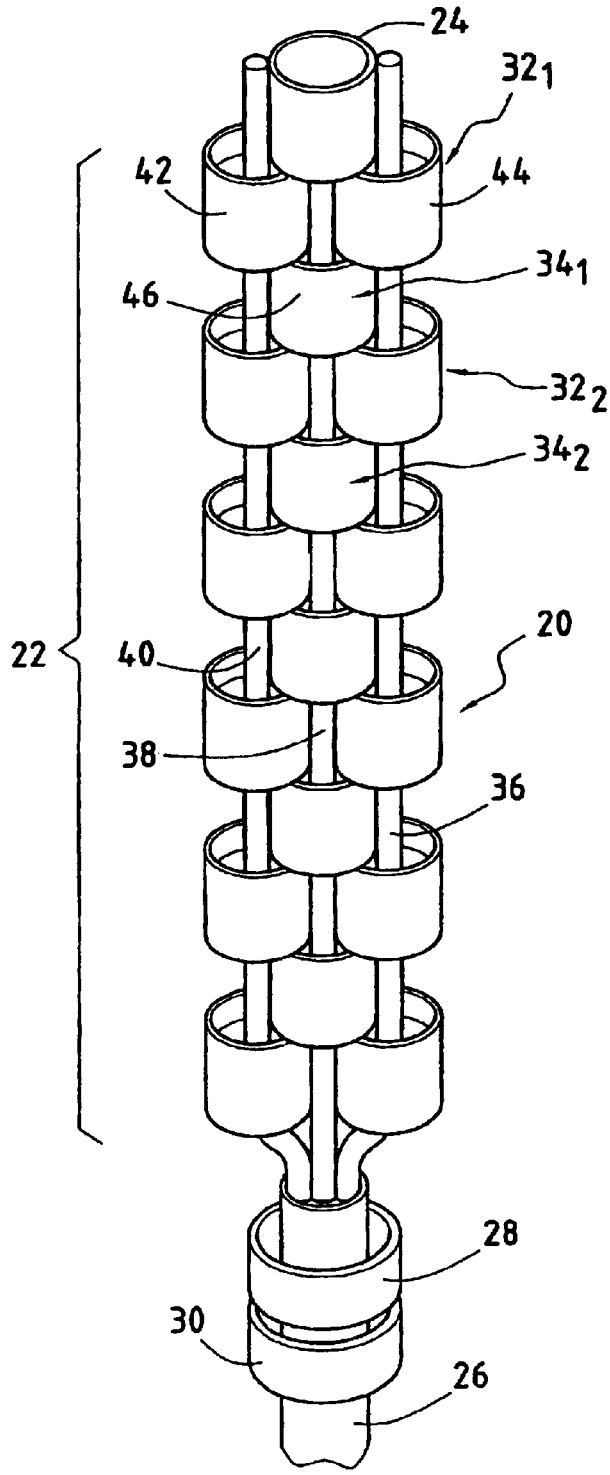
FIG. 2 is a perspective view of the antenna assembly in accordance with the invention.

FIG. 2 shows an antenna assembly 20. Functionally, it is constituted by a radiating portion 22, a blocking end 24 remote from a zone where it is connected to an antenna cable 26, and at its end close to the connection to the cable, the antenna preferably has two current traps referenced 28 and 30 respectively.

The radiating portion 20 of the antenna is constituted by a succession of radiating zones formed by first radiating zones $\mathbf{32}_1$, $\mathbf{32}_2$, etc. and by second radiating zones $\mathbf{34}_1$, $\mathbf{34}_2$, etc., the second radiating zones being disposed in alternation with the first radiating zones.

From a structural point of view, the radiating portion 22 of the antenna is made up of three rectilinear conductors 36, 38, and 40 which are mutually parallel. The conductor 38 is referred to as the "central" linear conductor and the other two conductors are referred to as "lateral" linear conductors. These conductors are at equal distances from the central conductor 38. The first radiating zones $\mathbf{32}_1$, $\mathbf{32}_2$, etc. are constituted by pairs of cylindrical conductive surfaces respectively referenced 42 and 44. The second radiating zones $\mathbf{34}_1$, $\mathbf{34}_2$, etc. are constituted by single substantially cylindrical conductive surfaces 46.

Figure 3:
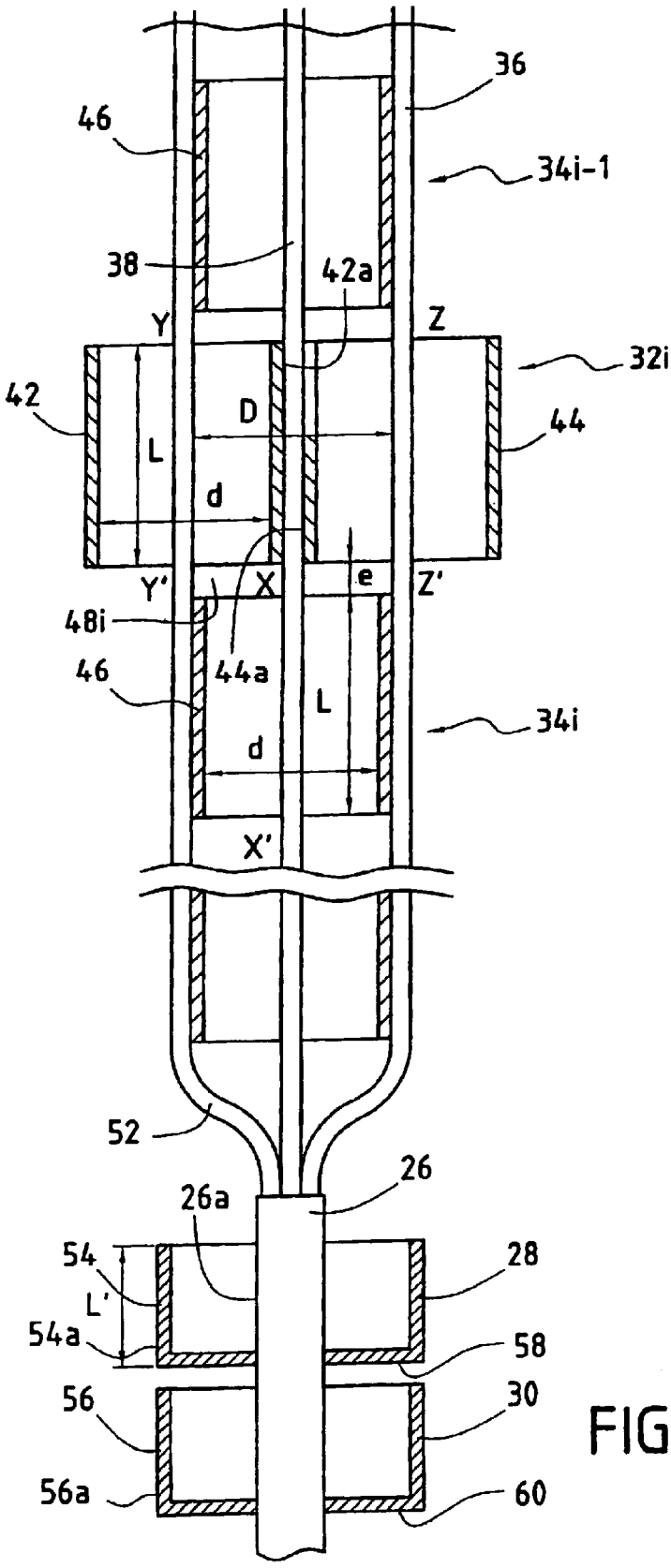
FIG. 3 is a fragmentary vertical section view of the antenna of the invention.

With reference now to FIG. 3, the structure of the first and second radiating zones $\mathbf{32}_i$ and $\mathbf{34}_i$ is described in greater detail.

As mentioned above, a second radiating zone $34_i$ is constituted by a single conductive cylinder 46 of diameter d substantially equal to the distance between the lateral rectilinear conductors 36 and 40. The cylinders 46 constituting the second radiating zones are of length L. The axis X–X' of the cylinder 46 coincides with the central rectilinear conductor 38, whereas its outside face 36*a* is bonded to the lateral conductors 36 and 40. This establishes an electrical connection between the cylinders 46 constituting the second radiating zones $34_i$ and the lateral conductors 36 and 40.

The first radiating zones $32_i$, as mentioned above, are each constituted by two conductive cylinders 42 and 44 that are identical to each other and preferably also identical to the cylinder 46 constituting a second radiating zone $34_i$. The cylinders 42 and 44 are thus likewise of diameter d and length L. Each cylinder 42, 44 has its respective axis Y–Y' or Z–Z' coinciding with a respective one of the lateral rectilinear conductors 36 and 40. The respective outside faces 44*a* and 42*a* of the conductive cylinders 42 and 44 are bonded to the central conductor 38. This establishes an electrical connection between the pairs of cylinders 42 and 44 constituting the first radiating zone $32_i$ and the central conductor 38. The length L of the cylinders 42, 44, and 46 corresponds to the half-wavelength $\lambda/2$.

It is necessary to leave a gap $48_i$, as defined below, between the various radiating zones $32_i$ and $34_i$, and this gap is of length e.

On each passage from a first radiating zone $32_i$ to a second radiating zone $34_i$, the various rectilinear conductors 36, 38, and 40 pass from a position of being coaxial to a position of being connected to a conductive cylinder, thus achieving a phase shift of substantially 180° between two successive radiating zones, thereby making it possible to sum effectively the currents flowing in each radiating zone whether in transmission or in reception.

Figure 4:
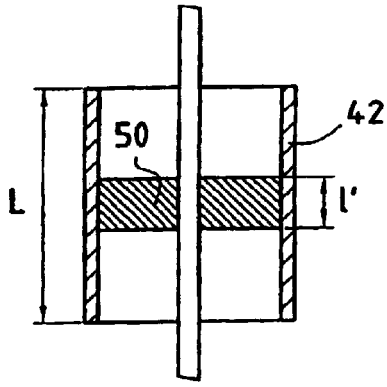
FIG. 4 is a fragmentary view showing an improved type of radiating zone.

The passband of the antenna is improved if the diameter d of the conductive cylindrical surfaces 42, 44, and 46 is increased. A suitable value for d is 0.08 $\lambda$. However, the phase shifts in the conductive cylindrical surfaces and in the rectilinear conductors 36, 38, and 40 are different for the same physical length of conductor. In order to compensate for these different phase shifts, in an improved embodiment of the antenna as shown in FIG. 4, a dielectric disk 50 is mounted inside each conductive cylinder 42, 44, or 46, e.g. a disk made of Teflon. Inserting such a disk 50 serves to compensate the electrical length of the conductive cylinder 42 and the rectilinear conductor 40. The length l' of the dielectric disk 50 in the direction of the rectilinear conductor 40 may be determined as follows. If the length of the dielectric of dielectric constant $\in$ is l' and if the length of the cylinder 42 is written L, the following relationship should apply:

$$\lambda/2=L+\in l'$$

As mentioned above with reference to FIG. 2, the antenna 20 preferably also includes at its end 52 connected to the coaxial antenna cable 26, two current traps 28 and 30. Each current trap 28, 30 is constituted by a conductive cylindrical surface 54, 56 coaxial with the cable 26 and of length L' corresponding to $\lambda/4$ where $\lambda$ is the working wavelength of the antenna. The bottom ends 54*a*, 56*a* of the cylinders 54 and 56 are connected to the outside face 26*a* of the coaxial cable 26 via respective annular portions 58 and 60 that are likewise conductive.

In a preferred embodiment, the antenna has N=14 radiating zones. The radiating zones are constituted by one or two cylindrical conductive surfaces having a ratio L/d equal to about 5.

With this antenna, for a working wavelength of 52 millimeters (mm), a passband of about 2.5% is obtained with gain of 10 dBiso (decibels as defined by the International Standards Organization).

Because the alternating radiating zones are implemented in the form of one conductive cylindrical surface and then two conductive cylindrical surfaces, the antenna is geometrically symmetrical overall about the central rectilinear conductor 38. This provides a radiation pattern in azimuth that is as omnidirectional as possible. In addition, the antenna is simple to make since it consists in bonding conductive cylindrical surfaces 42, 44, and 46 to rectilinear electrical conductors 36, 38, and 40. It should be added that in the event where each conductive cylinder is fitted with a dielectric disk, the dielectric disk also constitutes a spacer serving to hold the conductive cylindrical surface mechanically relative to the rectilinear electrical conductor and to center the cylindrical tubes on the rods.

What is claimed is:

1. An antenna of colinear type comprising a radiating portion comprising:

three substantially rectilinear conductive wire elements that are mutually parallel, comprising a central conductor and two lateral conductors; and 2N radiating zones constituted by alternating first radiating zones and second radiating zones:

each first radiating zone further comprising a cylindrical conductive element whose axis coincides with said central wire element and which is electrically connected to both of said lateral wire elements; and each second radiating zone further comprises two cylindrical conductive elements whose axes coincide substantially respectively with the lateral wire elements, said cylindrical elements being electrically connected to said central wire element; a gap being left between two consecutive radiating zones.

2. An antenna according to claim 1, in which each cylindrical element resonates at half wavelengths.

3. An antenna according to claim 2, in which each cylindrical element is of length L and contains internally a disk of a dielectric material having a dielectric coefficient $\in$, the disk extending orthogonally to the wire element and being of length l' in the direction of the wire element such that:

$$L+\in l'=\lambda/2.$$

4. An antenna according to claim 1, further comprising, at its end for connection to an antenna cable, at least one current trap comprising at least one conductive element surrounding said cable and of length $\lambda/4$, being electrically connected to said cable.

5. An antenna according to claim 1, in which the ratio between the length of a cylindrical conductive element over its diameter is about 5.

* * * * *